US007398869B2

(12) United States Patent
Novacek et al.

(10) Patent No.: US 7,398,869 B2
(45) Date of Patent: Jul. 15, 2008

(54) WHEEL FOR DRIVING A FLEXIBLE HANDRAIL

(75) Inventors: Thomas Novacek, Schwechat (AT); Thomas Illedits, Schwechat (AT)

(73) Assignee: Inventio AG, Hergiswil (CH)

( * ) Notice: Subject to any disclaimer, the term of this patent is extended or adjusted under 35 U.S.C. 154(b) by 48 days.

(21) Appl. No.: 11/448,465

(22) Filed: Jun. 7, 2006

(65) Prior Publication Data

US 2006/0272924 A1 Dec. 7, 2006

(30) Foreign Application Priority Data

Jun. 7, 2005 (EP) ..... 05104965

(51) Int. Cl.
*B66B 23/04* (2006.01)

(52) U.S. Cl. ..... 198/335

(58) Field of Classification Search ..... 198/331, 198/335, 336, 337; 152/325, 328
See application file for complete search history.

(56) References Cited

U.S. PATENT DOCUMENTS

| | | | | | |
|---|---|---|---|---|---|
| 1,447,365 | A | * | 3/1923 | Walther | 152/47 |
| 1,469,020 | A | * | 9/1923 | Preston | 152/52 |
| 4,226,273 | A | * | 10/1980 | Long et al. | 152/326 |
| 4,832,098 | A | * | 5/1989 | Palinkas et al. | 152/7 |
| 5,265,659 | A | * | 11/1993 | Pajtas et al. | 152/329 |
| 5,343,916 | A | * | 9/1994 | Duddey et al. | 152/5 |
| 5,522,492 | A | * | 6/1996 | Spriggs et al. | 198/331 |
| 6,068,353 | A | * | 5/2000 | Juncker et al. | 305/130 |
| 6,119,845 | A | | 9/2000 | Song | |
| 7,174,936 | B2 | * | 2/2007 | Becker et al. | 152/325 |

FOREIGN PATENT DOCUMENTS

| | | | |
|---|---|---|---|
| JP | 06278981 | A | 10/1994 |
| JP | 10120350 | A | 5/1998 |
| JP | 10167652 | A | 6/1998 |

* cited by examiner

*Primary Examiner*—Mark A Deuble
(74) *Attorney, Agent, or Firm*—Schweitzer Cornman Gross & Bondell LLP

(57) ABSTRACT

A wheel for driving a flexible handrail of an escalator or moving walk. The wheel can be turned about an axis of rotation and has a readily elastically deformable layer. The readily elastically deformable layer is formed by a body that is stable in form when free of stress. Arranged adjacent to an inner circumferential surface of the readily elastically deformable layer is an inner layer that is stiffer than the readily elastically deformable layer. Adjacent to an outer circumferential surface of the readily elastically deformable layer is an outer layer that is intended to rest against the handrail under static friction. Respective adjacent layers are coupled to each other in non-rotating manner.

13 Claims, 2 Drawing Sheets

Fig. 1
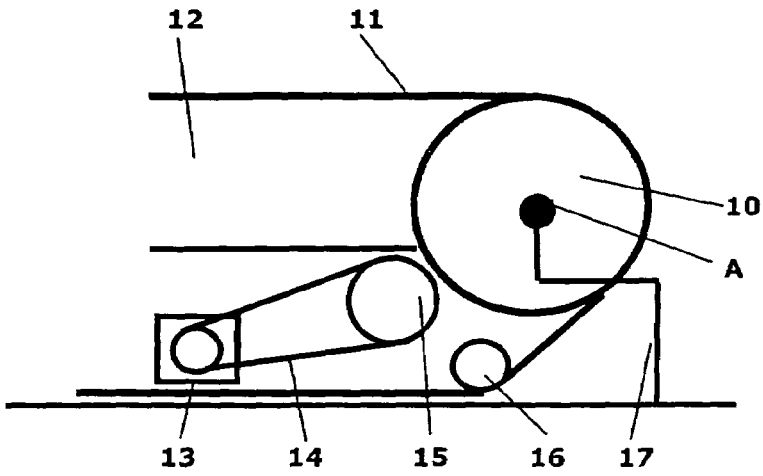
10
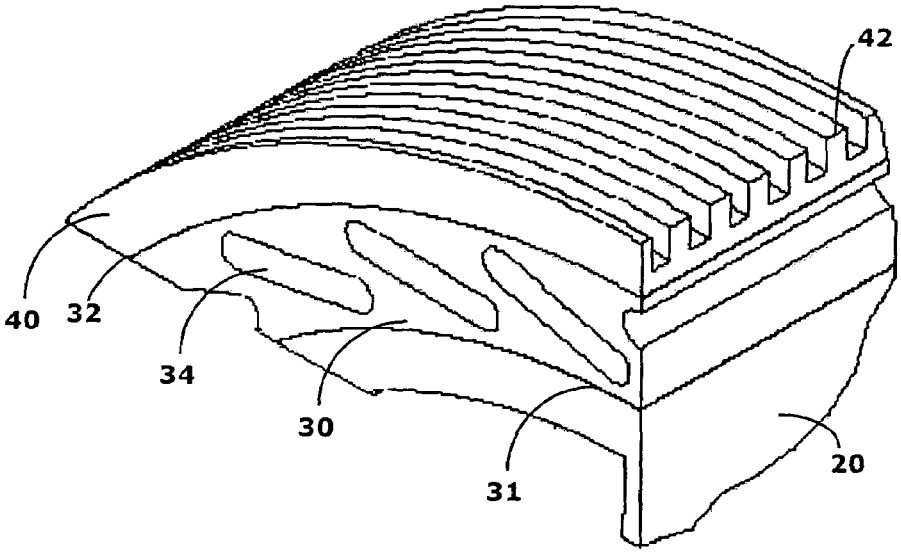
Fig. 2

WHEEL FOR DRIVING A FLEXIBLE HANDRAIL

The present invention relates to a wheel for driving a flexible handrail of an escalator or moving walk.

BACKGROUND OF THE INVENTION

Escalators and moving walks generally have balustrades that are locationally fixed at their sides. Mounted on or against the balustrades are band-shaped handrails that move relative to the balustrades as synchronously as possible with the step elements of the escalator or moving walk. The handrails consist essentially of a flexible band and can be driven by a wheel that can itself be driven directly or indirectly by a motor. At the same time, this wheel can also serve the function of a diverter sheave to divert the handrail where a change of direction of the handrail is required.

The drive of handrails should be as smooth and continuous as possible, free of jerks, as quiet as possible, and the wheel as well as the handrail itself should be constructed in such a manner that noise and wear are minimized. In particular, so-called slip-stick effects should be avoided. Slip-stick effects are instability effects associated with parameters which affect the static friction and sliding friction between the handrail and the contact surface of the wheel that drives the handrail. To realize a continuous drive of the handrail, sliding of the handrail relative to the wheel should be avoided, which means that the static friction should not fall below a certain amount. In practice, however, it is common for brief periods of sliding friction to occur, which is comparable to aquaplaning and results in the slip-stick effect.

To prevent slip-stick effects, a known wheel for driving a handrail is executed in such manner that it is formed essentially as a readily elastically deformable layer in the form of a driving-wheel tire. This driving-wheel tire is filled with a filling agent such as compressed air or an inert gas. The driving-wheel tire acts as a power transmission element in that its outer circumferential surface rests under pressure against the inner surface of the handrail so that on rotation of the driving-wheel tire the handrail is driven by the static friction acting between the power transmission element and the handrail.

Disadvantages of such driving wheel include the formation of bulges on the driving-wheel tire which occurs as a consequence of its elasticity, the substantial wear, the production of noise, and the risk of damage especially to the gas-filled driving-wheel tire.

It is accordingly an objective of the present invention to provide a wheel for driving a flexible handrail of an escalator or moving walk with which the disadvantages of the prior art are avoided.

BRIEF DESCRIPTION OF THE INVENTION

The foregoing and other objectives are fulfilled according to the invention by the characteristics of the characterizing part of Claim 1.

Important advantages of the new wheel are prevention of the slip-stick effect between the wheel and the handrail and prevention of the formation of bulges in the contact area of the wheel and handrail.

The slip-stick effect is essentially determined by the ratio of static friction and sliding friction between the outer circumferential surface of the tire cover and the handrail against which it is pressed by gas pressure. The type of friction essentially depends firstly on the coefficients of static and sliding friction between the materials of the tire cover and the handrail which are themselves affected by their surface structure and surface roughness; secondly on the pressure under which the tire cover rests against the handrail; and thirdly on the extent of the contact surface between the tire cover and the handrail.

The formation of bulges essentially depends on the respective rigidity of the material as well as the thickness of the material since, depending on these, bulges can form between the tire cover and the handrail both in and perpendicular to the direction of motion and result in vibrations that create noise and cause wear.

If the slip-stick effect is avoided, the creation of noise is prevented to the extent that it depends on the energy that is freed on transition from static friction to sliding friction. If the formation of bulges is prevented, the creation of noise is reduced to the extent that it depends on the resulting vibrations. At the same time, wear of the respective components and the power required for driving is reduced, while ride comfort is increased.

Whereas the aforesaid conventional wheel for driving a flexible handrail has a readily elastically deformable layer in the form of a tire cover filled with pressurized gas, in the wheel according to the invention the readily elastically deformable layer is formed by a body made from a solid material that in itself, and for example without the effect of pressurized gas, is stable in form and is readily elastically deformable.

Arranged adjacent to an inner circumferential surface of the readily elastically deformable layer or an intermediate layer is an inner layer that is stiffer than the readily elastically deformable layer. The inner layer generally directly adjoins the intermediate layer and is non-rotatably connected to the intermediate layer.

Arranged adjacent to an outer circumferential surface of the readily elastically deformable layer or intermediate layer is an outer layer that is intended to rest under sufficient pressure against the handrail that is to be driven. The outer layer generally directly adjoins the intermediate layer and is non-rotatably connected to the intermediate layer.

The intermediate layer stretches the outer layer onto the handrail in such manner that when the wheel is driven, a frictional engagement occurs between the outer layer and the surface of the handrail with which it is in contact, whereby the rotation of the wheel is transformed into movement of the handrail.

The inner layer can be connected to a rim body of the wheel or can form an integral component of such a rim body.

The solid body that forms the elastically readily deformable layer is preferably a body that is least approximately a hollow cylinder. This body can have recesses to facilitate its elastic deformability. The recesses can communicate with the outside of the layer or be enclosed within it.

It is, however, also possible for an elastically readily deformable band to serve as intermediate layer. In this case, the band is laid or arranged around the inner layer (e.g. a rim body) and then forms a body like a hollow cylinder.

The outer layer, which is elastically relatively flexible, preferably has a stiffening. The stiffening can be integrated into the outer layer or can form a sub-layer that is arranged adjacent to the outer layer. The stiffening effect can he created with stiffening elements, for example elongated stiff elements in the form of wires or a mesh. Possible materials for execution of the stiffening are metals and/or natural fibers and/or plastics.

The outer layer may have a structure on its outer circumferential surface. A structure with grooves running in the direction of the circumference (lengthwise grooves) allows water that penetrates through the handrail in the area of contact of the handrail and the outer layer to flow off. Other structures can serve to improve the frictional engagement with the handrail.

It is preferable for the wheel to be driven by a lantern pinion wheel, such as is shown in EP 1464609. The lantern pinion wheel engages in the step chain and turns the wheel which comes into contact with the handrail either on the upper or lower surface of the handrail and moves the handrail. Alternatively, the wheel can also be driven by a conventional handrail drive unit such as, for example, a friction wheel.

BRIEF DESCRIPTION OF THE DRAWINGS

Further characteristics and advantages of the wheel according to the invention are explained below in relation to exemplary embodiments and by reference to the annexed drawings, wherein:

FIG. 1 is a highly simplified side view representation of a moving walk or escalator with a handrail that can be driven by means of a wheel according to the invention;

FIG. 2 is a diagrammatical representation of a portion of a first embodiment of a wheel according to the invention;

Identical and similar, or identically functioning, components of the various embodiments of the new wheel are referenced by the same numbers in FIGS. 2, 3, and 4.

DETAILED DESCRIPTION OF THE INVENTION

Figure 3:
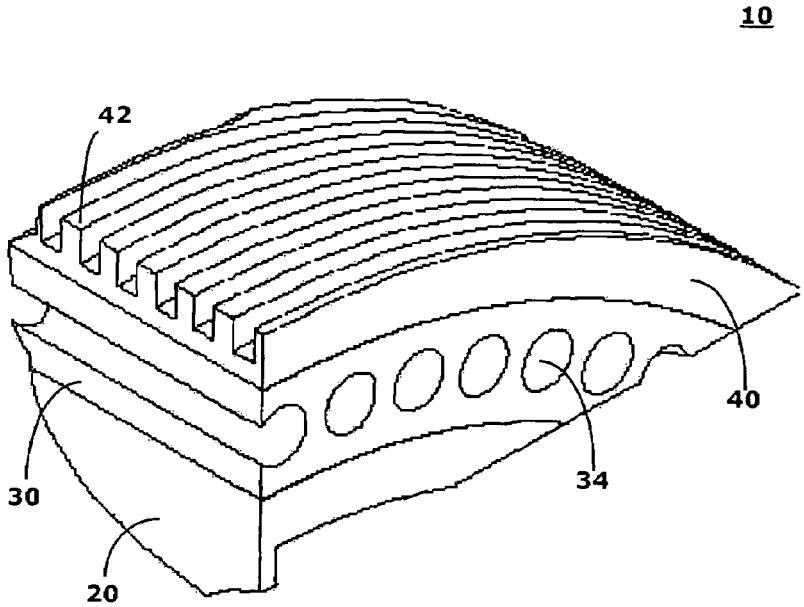
FIG. 3 is a diagrammatical representation of a portion of a second embodiment of a wheel according to the invention.

FIG. 1 shows a wheel 10 according to the invention that can be turned about an axis of rotation A and drives a handrail 11. The handrail 11 is located on the upper edge of a balustrade 12 that is arranged at the side of not-shown step elements of the escalator or moving walk. The handrail 11 lies longitudinally at almost 180° to the wheel 10. Driving of the wheel 10 takes place, for example, by means of a motor 13 via an endless element 14 and a drive wheel 15. The wheel 10 is fastened in a conventional manner to a locationally fixed supporting construction 17.

FIG. 2 shows a wheel according to the invention that has an inner layer 20, an intermediate layer 30, and an outer layer 40.

The inner layer 20 forms a relatively stiff or rigid base body that may be formed in an integral manner with a not-shown rim body of the wheel 10 or fastened to such a rim body. The inner layer or base body 20 can be made, for example, of PA-GF30, PP-GF30, PA-G, or of another suitable material, for example metal, with similar material properties.

The intermediate layer 30 borders radially adjacent the inner layer 20 and is connected with the latter in a suitably non-rotatable manner such that rotation of the rim body with the inner layer 20 causes synchronous rotation of the intermediate layer 30.

The intermediate layer 30 is formed from a body of a solid material that when not under stress, is not only stable in volume like the tire cover of a pneumatic tire, but also stable in form and while being sufficiently elastically deformable.

The intermediate layer 30 is bounded in the axial direction by two radial bounding surfaces 31, 32, as indicated in FIG. 2. In addition, the intermediate layer 30 has a plurality of recesses 34 that extend between the radial bounding surfaces 31, 32. In the present exemplary embodiment according to FIG. 2, the recesses are slit-shaped in a cross section perpendicular to the axis of rotation A. The recesses 34 are slit-shaped. The recesses 34 communicate with the side edges of the intermediate layer 30 and thereby form breakthroughs, or at least breakouts to the edges, and are therefore filled with ambient air. The purpose of the recesses is to increase the elastic deformability of the intermediate layer 30.

The recesses 34 can also have other forms, for example rhomboid or rectangular, and other arrangements, e.g. single or multiple, and can be enclosed within the intermediate layer 30 and be filled with air or a suitable gas. In other words, the recesses 34 can contain a compressible, preferably fluid, material.

As previously stated, the solid material from which the body of the intermediate layer 30 is formed is readily elastically deformable. Within the context of the present description, materials that can be considered as readily elastically deformable are such materials as have a modulus of elasticity in the range of approximately 10 to 50 MPa. Suitable materials are, for example, PUR, elastomers, NBR, SBR, and other materials with similar material properties. Especially suitable are materials that allow formation of an intermediate layer 30 that is particularly readily deformable in the radial direction, but that in the tangential direction or the direction of the circumference is stable in form and less elastic.

Adjoining the outer circumferential surface 32 of the intermediate readily deformable layer 30 is outer layer 40. The outer layer 40 is joined to the intermediate layer 30 in such manner that rotation of the intermediate layer 30 causes synchronous rotation of the outer layer 40. The connection of the intermediate layer 30 to the outer layer 40 is such that the said motional coupling may be attained through frictional engagement or bonding or fusion, as known in the art.

The outer layer 40 is pretensioned outward (radially) through the intermediate layer 30, which in an installed state is toward the handrail 11. This means that the outer layer 40 rests under pressure against the handrail 11. This pressure, the size of the contact surface through which the outer layer 40 and the handrail 11 touch, and the materials and structures of the outer layer 40 and of the handrail 11, determine the friction between the outer layer 40 and the handrail 11. This friction is sufficiently high to provide continuous and permanent frictional engagement between the outer layer 40 and the handrail 11 so that the rotation of the wheel 10 is constantly (i.e. without occurrence of the slip-stick effect) transformed into movement of the handrail 11.

The outer layer 40 has ribs 42 on an outer surface intended to rest against the handrail, and preferably on a circumferential surface. In the exemplary embodiment shown, the ribs run in the direction of the wheel's circumference and are therefore referred to as longitudinal ribs. The actual contact surface through which the outer layer 40 rests against the handrail 11 is formed by the outer bounding surfaces of the ribs 42.

The outer layer 40, or covering, is readily elastically deformable. Suitable materials for manufacturing the outer layer are, for example, elastomers, NBR, SBR, HNBR, and other materials with similar material properties.

Shown in FIG. 3 is a wheel that differs from the wheel 10 of FIG. 2 as follows: In a cross section perpendicular to the axis of rotation A, the recesses 34 of the intermediate, readily elastically deformable layer 30 are not slit-like but are circular, i.e. the recesses are cylindrical and the main axes of the cylindrical recesses run parallel to the axis of rotation of the wheel 10.

Figure 4:
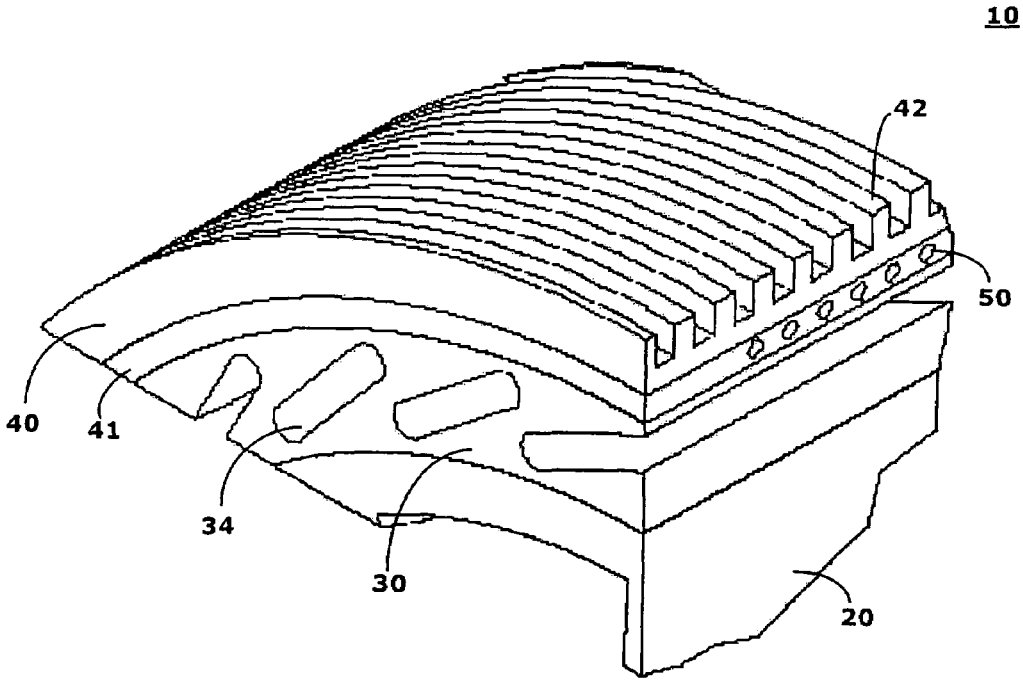
FIG. 4 is a diagrammatical representation of a portion of a third wheel according to the invention.

The wheel 10 shown in FIG. 4 differs from the wheel of FIG. 2 as follows: The outer layer 40 has a stiffening 50. In the present exemplary embodiment the stiffening 50 is enclosed within a sub-layer 41 of the outer layer 40. Serving as the actual stiffening 50 are wires, for example metal wires, or fibers or fabrics, for example glass fiber or a high-strength polymer, such as KEVLAR™, that extend in the direction of the circumference. The sub-layer 41 is thus joined with the outer layer 40, and if forming a layer adjacent to intermediate layer 30, joined also thereto, in such manner that with respect to rotational movement it is also coupled with its adjacent layers. The stiffening 50 can also be arranged inside or on the outer layer 40 itself. The purpose of the stiffening 50 is so that the outer layer 40 rests perfectly against the handrail 11, since the outer layer 40 is readily deformable and soft but at the same time formation of bulges and the associated disadvantages must be avoided.

As an alternative to the above embodiments, a wheel of several layers is also conceivable in which instead of the plurality of recesses in the layer 30, several hard and soft layers result in the same behavior as in the wheel described above.

We claim:

1. A handrail construction for an escalator or moving walk, comprising a flexible handrail and a drive wheel for driving the flexible handrail that can be turned about an axis of rotation, the drive wheel further comprising:

a readily elastically deformable layer formed by a body that in itself is stable in form when it is free of stress;

an inner layer adjacent to an inner circumferential surface of the readily elastically deformable layer, the inner layer being is stiffer than the readily elastically deformable layer; and an outer layer adjacent to an outer circumferential surface of the readily elastically deformable layer, the outer layer being pre-tensioned to rest against the handrail under static friction;

the respective adjacent layers being coupled to each other in non-rotating manner.

2. The handrail construction according to claim 1, wherein the inner layer is formed on a rim body of the wheel.

3. The handrail construction according to claim 1, wherein the inner layer is a part of a rim body of the wheel.

4. The handrail construction according to claim 1, 2, or 3 wherein the body forming the readily elastically deformable layer is formed essentially as a hollow cylinder and has recesses.

5. The handrail construction according to claim 4 wherein the recesses extend in a direction of a circumference of the wheel.

6. The handrail construction according to claim 4, wherein the recesses extend to an outer surface of the readily elastically deformable layer.

7. The handrail construction according to claim 4, wherein the recesses are enclosed within the readily elastically deformable layer and contain a compressible material.

8. The handrail construction according to claim 1, 2 or 3 wherein the outer layer has a stiffener.

9. The handrail construction according to claim 8 wherein the stiffener comprised elongated stiff elements chosen from wire and mesh.

10. The handrail construction according to claim 8, wherein the stiffener is contained in a sub-layer of the outer layer.

11. The handrail construction according to claim 10, wherein the outer layer has a ribbed outer surface adapted to rest against the handrail surface.

12. The handrail construction according to claim 1, 2 or 3, wherein the outer layer has a ribbed outer surface adapted to rest against the handrail.

13. The handrail construction according to claim 12, wherein the ribs extend in a direction of a circumference of the wheel.

* * * * *